US005286333A

United States Patent [19]

Orlandi

[11] Patent Number: 5,286,333

[45] Date of Patent: Feb. 15, 1994

[54] DEVICE FOR SUPPORTING AND DRIVING THE LABEL GUMMING AND TRANSFER UNIT IN LABELING MACHINERY

[75] Inventor: Ireneo Orlandi, San Giorgio di Mantova, Italy

[73] Assignee: Alfa Costruzioni Meccaniche S.p.A., Mantova, Italy

[21] Appl. No.: 110,795

[22] Filed: Aug. 23, 1993

Related U.S. Application Data

[63] Continuation of Ser. No. 721,096, Jun. 25, 1991, abandoned.

[30] Foreign Application Priority Data

Dec. 21, 1990 [IT] Italy ..... 42545 A/90

[51] Int. Cl.[5] ..... B65C 9/08

[52] U.S. Cl. ..... 156/570; 156/571

[58] Field of Search ..... 156/570, 571, 556, 569, 156/568, 578; 118/602

[56] References Cited

U.S. PATENT DOCUMENTS

| | | | |
|---|---|---|---|
| 1,230,138 | 6/1917 | Eick | 156/570 |
| 2,255,308 | 9/1941 | Biner | 156/570 |
| 3,591,168 | 7/1971 | Zodrow | 271/36 |
| 3,594,258 | 7/1971 | Dullinger | 156/570 |
| 3,928,120 | 12/1975 | Zodrow | 156/568 |
| 4,292,117 | 9/1981 | Zodrow et al. | 156/571 |
| 4,336,098 | 6/1982 | Zodrow | 156/571 |
| 4,395,968 | 8/1983 | Wahnschaff et al. | 118/602 |
| 4,404,058 | 9/1983 | Marchini | 156/571 |

FOREIGN PATENT DOCUMENTS

| | | | |
|---|---|---|---|
| 2069151 | 8/1971 | France | B65C 3/00 |

*Primary Examiner*—David A. Simmons
*Assistant Examiner*—William J. Matney, Jr.
*Attorney, Agent, or Firm*—Darby & Darby

[57] ABSTRACT

The device forms part of a high speed labeling machine of the type utilizing cold-applied gums, typically as in bottling plant, and serves to support and drive the rotary unit by which single labels are gummed and transferred to the point of application; to advantage, the gumming roller and the center station which rotates the single labels into position are suspended from above, thereby avoiding the damage caused to seals by solidifying and encrusted gum spilled in normal operation, and facilitating the operation of washing the machine (whether automatically or by hand) given that there is no need to dismantle any component part.

7 Claims, 2 Drawing Sheets

DEVICE FOR SUPPORTING AND DRIVING THE LABEL GUMMING AND TRANSFER UNIT IN LABELING MACHINERY

This is a continuation of application Ser. No. 07/721,096, filed Jun. 25, 1991, now abandoned.

BACKGROUND OF THE INVENTION

The present invention relates to a device serving to support and drive the unit by which labels are gummed and transferred in a labeling machine.

Conventional labeling machines, and in particular high speed machines with an output capacity of 40 to 50 thousand pcs/h, generally comprise a rotary platform of which the periphery affords a plurality of plates to receive containers for labeling.

In the course of its rotation, the platform passes through one or more labeling stations comprising a label dispensing magazine, a gumming roller and a transfer drum disposed about a center station with revolving segments or paddles.

The segments are smeared with glue by the gumming roller in such a way as to pick up the labels from the magazine; each label clings to the respective segment by way of its reverse side and is conveyed thus to the transfer drum, taken up by grippers, and applied to one of a succession of containers conveyed through the machine.

The gums are utilized cold, and generally will be water soluble, polyvinyl or casein based adhesives. In labeling machines of the type in question, the gumming roller and the center station supporting the segments will stand generally on a base or bed housing the prime mover of the machine and the transmission components, which are oil-immersed. In order to prevent the risk of gum leaking down toward the delicate mechanisms and trains of gears located internally of the base, use is made of rubber couplings, O-rings, labyrinth seals, etc., that is, parts designed to ensure a fluid-tight barrier.

The main drawback encountered in such machines is that the gum, albeit initially fluid, tends to dry out during standstill periods and solidify into lumps that can ruin a seal fashioned in rubber. Metal labyrinth seals are also affected, becoming partly obstructed by a sediment of adhesive matter and tending consequently to generate a pumping effect when in rotation; this, for example, favors an undesirable suction of water and/or gum during cleaning operations.

Such problems are overcome currently by dismantling the affected parts and cleaning them separately, though this is a lengthy procedure when compared with the more simple expedient of spray-washing the machine prior to shutting off the drive.

Despite such precautionary measures, moreover, bearings still need to be replaced periodically, and indeed somewhat frequently.

In most cases, the labeling unit is mounted to a slide with crossed slots (of dovetail profile) on which the components can be traversed in a radial direction to give positioning along two mutually perpendicular axes and thus permit of adjusting the timing and pressure with which the label is applied during operation of the machine.

Thus, the slide constitutes a further part of the machine exposed to the spilled adhesive.

The object of the invention is to overcome the drawbacks mentioned, and in particular to embody a device for supporting and driving the gumming roller and the center station with its associated segments, such as will both disallow any leakage of water and/or gum into the internal drive mechanisms of the machine and enable an easy recovery of water or washing liquid at one and the same time.

A further object of the invention is to permit of washing down the labeling machine either manually or automatically without the need to dismantle any of its component parts.

Another object of the invention is to afford ease of access to transmission components of the device and thus facilitate inspection and servicing.

SUMMARY OF THE INVENTION

The stated objects are fully realized in a device for supporting and driving the gumming and transfer unit in a labeling machine substantially as recited in the appended claims.

The device disclosed comprises means by which a gumming roller and a center station with rotating segments are supported from above; moreover, these same means also carry the drive head of the unit, which is located above the gumming roller and the center station and connected to the main drive of the machine by way of a sealed transmission.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
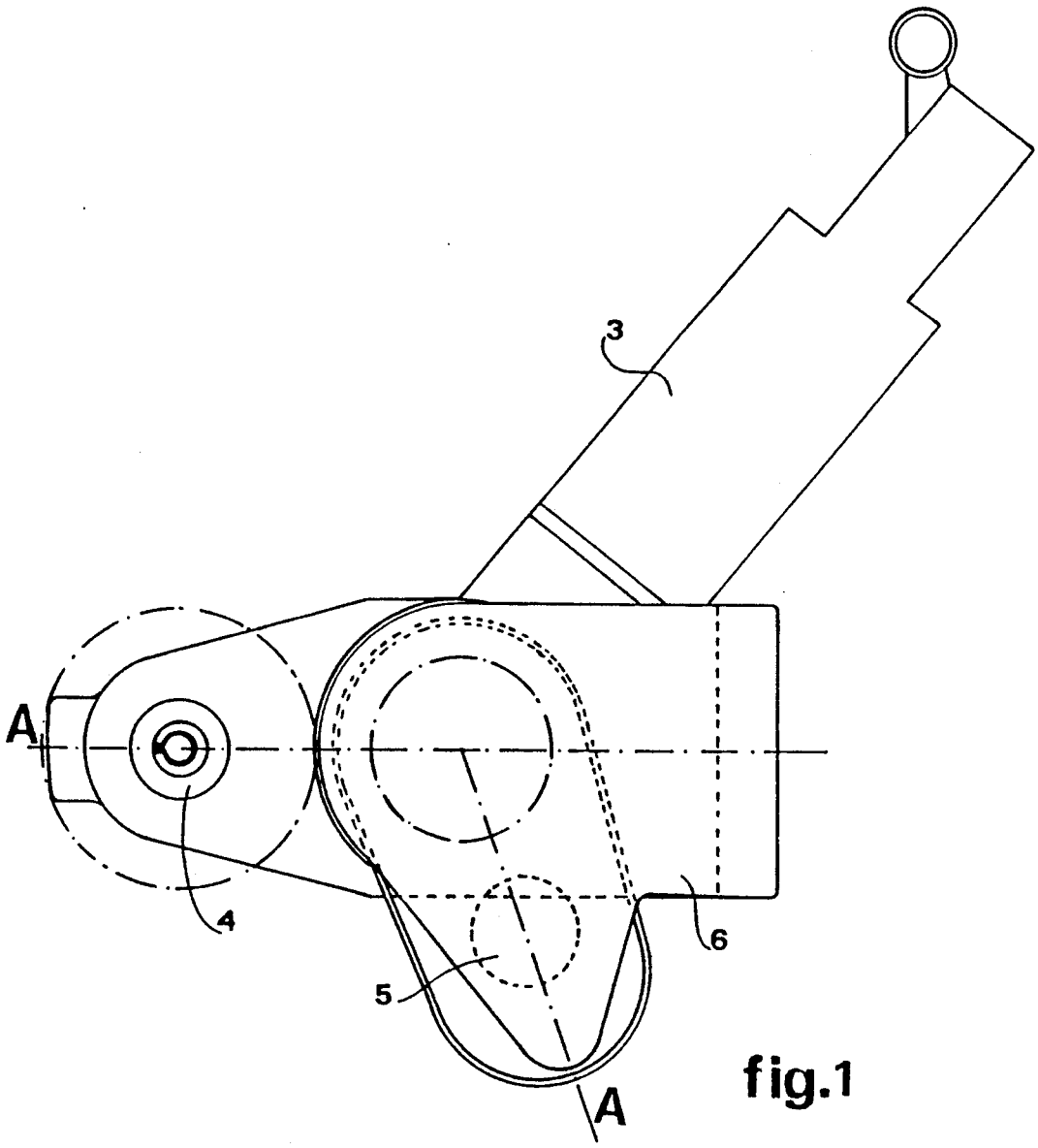
FIG. 1 illustrates the device in plan.

Referring to the drawings, 1 denotes the central transfer station of a labeling machine.

The station 1 comprises a plurality of vertical and parallel rotating shafts 9 associated with a top platform 25, which are spaced apart one from the next at identical angular distance and partially inserted into a bottom platform 24.

In the example illustrated, the station comprises four such shafts spaced apart at intervals of 90°.

Each shaft 9 carries a segment denoted 2, and is supported by the top platform 25 in such a way as to revolve around the axis 26 of a center shaft 11. The shafts 9 and platforms 24 and 25 are set in motion by power transmission components (not shown in the drawings) housed in a top drive head 8. The transmission components themselves are set in motion by the center shaft 11, which rotates about the axis 26 of the station 1 and is accommodated in a protective sleeve 10.

The center shaft 11 in its turn is set in rotation by mechanical transmission means housed within the base 7 of the machine and connected to a main drive system not illustrated in the drawings.

Each segment 2 comprises an outwardly directed surface 27 positioned to enter into contact with a gumming roller 5, from which it receives adhesive, and with a dispensing magazine 3 from which single labels are taken up onto the gummed surface 27. Rotating about the center axis 26 and about the relative shaft 9, the segment 2 encounters a drum denoted 4, whereupon the label is detached from the contact face 27 by grippers (not illustrated) and transferred to one of a succession of containers directed through the machine.

Figure 2:
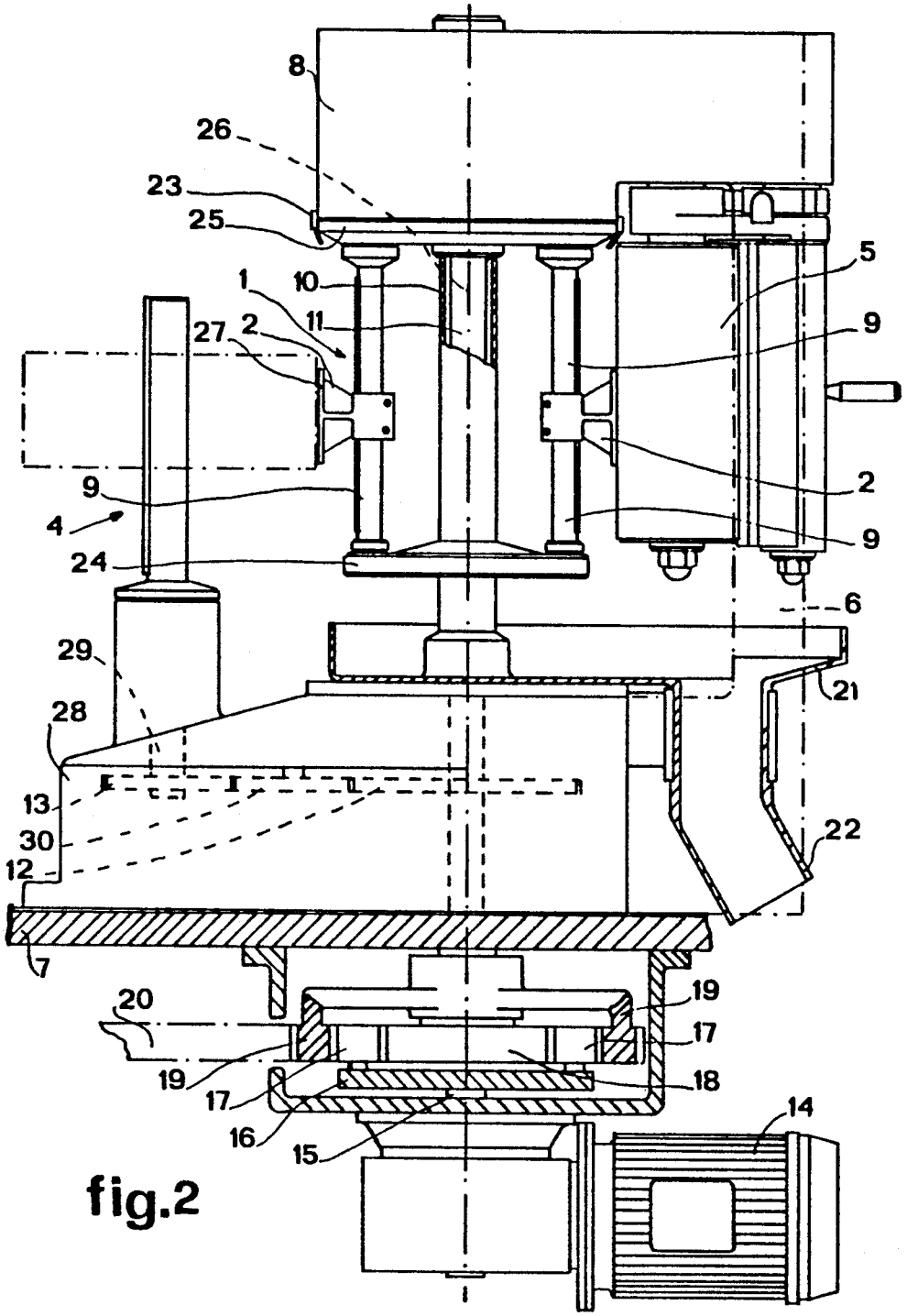
FIG. 2 is an elevation of the device viewed partly in section through A—A of FIG. 1.

Referring to FIG. 2 of the drawings, 14 denotes a geared motor (this might be replaced by a graduated handwheel) housed internally of the base 7 and driving a shaft 15 disposed coaxial with the center shaft 11.

The shaft 15 transmits rotation to a carrier 16 supporting a plurality of freely revolving planet wheels 17, which are positioned to mesh internally with a pinion 18 keyed to the center shaft 11 and externally with a ring gear 19 associated freely with the center shaft 11.

The ring gear 19 meshes additionally with a gear 20 set in rotation by the main drive system (not shown in the drawings) of the labeling machine.

28 denotes a protective casing positioned over the base 7 of the machine; the casing houses a gear 12 keyed to the center shaft 11 and in mesh with an idle gear 30 meshing in turn with a further gear 13 keyed to the shaft 29 driving the transfer drum 4, in such a way that rotation can be transmitted to the drum.

21 denotes a vessel provided with a drain outlet 22 serving to collect adhesive, liquids and cleansing fluids etc., falling from the labeling unit, i.e. from the center station and the gumming roller. The vessel occupies a position between the bottom platform 24 and the casing 28, and encircling the protective sleeve 10.

The base 7 and the upper drive head 8 are connected by a pillar or upright 6 serving also to provide means by which the center station 1 and the gumming roller 5 are supported from overhead.

The main drive system housed in the base 7 and the transmission components housed in the drive head 8 are interconnected through mechanical transmission means housed in the base itself and via the center shaft 11, though in an alternative arrangement (not illustrated) this same connection could be effected via transmission means housed in the pillar 6, thus eliminating the center shaft 11 and isolating the gumming station from the base altogether.

The transmission components housed in the top drive head 8, which operate the center station 1 and the gumming roller 5, are oil-immersed and enclosed in a fluid-tight enclosure created preferably with rubber seals.

The machine is adjusted for operation with a given type and diameter of container in the following manner: the geared motor 14 is activated in order to turn the shaft 15, hence the carrier 16 and the planet wheels 17, and rotate the center shaft 11 through the required angle, while the gear 20 associated with the main drive remains stationary. During normal operation, conversely, this gear 20 drives the ring gear 19, hence the center shaft 11, whilst the carrier 16 remains idle.

The device according to the invention affords an overhead support from which to suspend the center station and gumming roller in labeling machinery; accordingly, it becomes possible to eliminate the problems connected with damage caused to rubber seals by hardened lumps of adhesive, as liquids and residual gum tend to cascade freely during washing operations and fall into the collection vessel 21, without penetrating the drive head 8.

Thus, the machine can be spray cleaned without any components being dismantled.

As illustrated in FIG. 2, the periphery of the drive head 8 affords a plurality of spray nozzles 23 by means of which to effect an automatic wash of the lower parts of the machine.

A further advantage of the device disclosed is that a change of the size of container in production can be accommodated simply by advancing or retarding the transfer of the labels, given that the pressure brought to bear in application of the label remains unaltered; by contrast, in conventional machines with slotted guides, the corresponding adjustment has the effect of upsetting the apply pressure.

Once the apply pressure is adjusted in the device disclosed, on the other hand, the central axes of the transfer drum, the container to be labeled and center station undergo no change in position.

Another advantage derives from the ready access afforded to transmission components in the drive head 8, hence the ease with which inspection and servicing operations can be carried out.

A device according to the invention requires less maintenance than prior art embodiments, and can be integrated into conventional labeling machines with a minimum of simple modifications.

What is claimed is:

1. A device for supporting and driving the label gumming and transfer unit of a labeling machine comprising:

a plurality of rotatable segments or paddles carried by a center station;

a magazine, a roller and a drum distributed around the center station, by which labels are respectively dispensed, gummed and transferred to containers for labeling through interaction with the segments;

drive means positioned above the gumming and transfer unit, said drive means setting the gumming roller and the center station in motion, said drive means suspending the gumming roller and the center station from above, whereby any excess gum materials and solvents used with said gumming roller and center station cannot fall on said drive means, and support means for supporting said drive means above said gumming roller and center station.

2. A device as in claim 1, wherein said support means comprises a pillar or upright member that interconnects between a base and a top drive head, said top drive head housing said drive means including components by which motion is transmitted to the gumming roller and the center station, said base supporting the labeling machine and housing a main drive system.

3. A device as in claim 2, wherein the pillar or upright member is hollow and accommodates mechanical components transmitting motion from the main drive system housed in the base to the motion transmission components housed in the top drive head.

4. A device as in claim 2, further comprising a center shaft supported rotatably within a sleeve interconnecting the top drive head and the base, said center shaft transmitting motion from the main drive system housed in the base to the motion transmission components housed in the top drive head.

5. A device as in claim 1 wherein said support means by which the gumming roller and the center station are suspended from above comprise a pillar or upright member interconnecting a base supporting the machine and housing a main drive system, and a top drive head housing components by which motion is transmitted to the gumming roller and the center station, further comprising mechanical transmission means wherein a gear set in rotation by the main drive system of the labeling machine connects with the motion transmission components housed in the top drive head, said gear being connected to and being set in motion by a geared motion, said mechanical transmission means allowing the gear to remain at a standstill when adjusting the timing of the center station.

6. A device as in claim 5, wherein said mechanical transmission means comprise a shaft set in motion by the geared motor to rotate a carrier supporting a plurality of planet wheels meshing internally with a pinion keyed to a center shaft and externally with a ring gear that is associated freely with the center shaft and in mesh also with the gear set in rotation by the main drive system of the labeling machine.

7. A device as in claim 1 wherein said support means by which the gumming roller and the center station are suspended from above comprise a pillar or upright member interconnecting a base supporting the machine and housing a main drive system, and a top drive head the houses said drive means including components by which motion is transmitted to the gumming roller and the center station, further comprising a plurality of spray nozzles on the top drive head to wash down lower parts of the labeling machine automatically, and a vessel affording a drain outlet to collect the liquids utilized in washing down and any residual gum removed in the washing down operation.

* * * * *